United States Patent [19]

Bailey et al.

[11] Patent Number: 4,865,137

[45] **Date of Patent: * Sep. 12, 1989**

[54] DRILLING APPARATUS AND CUTTER

[75] Inventors: Thomas F. Bailey; John Campbell, both of Houston, Tex.

[73] Assignee: Drilex Systems, Inc., Houston, Tex.

[ * ] Notice: The portion of the term of this patent subsequent to Feb. 2, 2005 has been disclaimed.

[21] Appl. No.: 186,716

[22] Filed: Apr. 22, 1988

Related U.S. Application Data

[63] Continuation of Ser. No. 896,060, Aug. 13, 1986, abandoned.

[51] Int. Cl.[4] ..... E21B 10/34; E21B 10/22

[52] U.S. Cl. ..... 175/269; 175/228; 175/368; 175/370; 175/371; 384/95

[58] Field of Search ..... 175/269, 227, 267, 367, 175/376, 371, 337, 357, 368–370, 372, 228; 384/95, 96

[56] References Cited

U.S. PATENT DOCUMENTS

| | | | |
|---|---|---|---|
| 1,792,604 | 2/1931 | Reed | 175/372 |
| 1,858,980 | 5/1932 | Behnke | 175/372 |
| 1,896,231 | 2/1933 | Fletcher | 175/228 |
| 1,921,700 | 8/1933 | Reed | 175/367 |
| 1,921,702 | 8/1933 | Reed | 175/367 |
| 2,013,839 | 9/1935 | Pickin | 175/370 |
| 2,104,819 | 1/1938 | Schlumpf et al. . | |
| 2,190,365 | 2/1940 | Maxwell . | |
| 3,047,344 | 7/1962 | Gros . | |
| 3,386,521 | 6/1968 | Chadderdon et al. | 175/269 |
| 3,656,564 | 4/1972 | Brown | 175/267 X |
| 3,998,500 | 12/1976 | Dixon | 175/337 X |
| 4,161,343 | 7/1979 | Brashear . | |
| 4,235,295 | 11/1980 | Zyglewyz . | |
| 4,266,622 | 5/1981 | Vezirian . | |
| 4,293,167 | 10/1981 | Mayo et al. . | |
| 4,413,918 | 11/1983 | Thomas . | |
| 4,444,518 | 4/1984 | Schramm et al. . | |
| 4,478,299 | 10/1984 | Dorosz . | |
| 4,533,003 | 8/1985 | Bailey et al. . | |
| 4,600,064 | 7/1986 | Scales et al. | 175/368 |
| 4,722,615 | 2/1988 | Bailey et al. | 384/96 |

FOREIGN PATENT DOCUMENTS

| | | | |
|---|---|---|---|
| 0226328 | 8/1985 | Fed. Rep. of Germany | 175/227 |
| 137080 | 9/1960 | U.S.S.R. | 175/370 |
| 1410449 | 10/1975 | United Kingdom | 175/371 |

*Primary Examiner*—Hoang C. Dang

*Attorney, Agent, or Firm*—Edgar A. Zarins; Malcolm L. Sutherland

[57] ABSTRACT

An underreamer including a body having a bore therethrough, an arm mounted at its upper end to the body, a sleeve member detachably secured to the lower end of each arm and adapted to receive the frictional wear caused by the rotation of the conical cutter mounted thereto. Bearings and seals disposed between the cutter and the sleeve member provide smooth rotation of the cutter. In addition, locking pins and bearings extending between the arm and the sleeve member secure the sleeve on the arm. The arms are pivotally mounted in slots in the body and mechanical structure is provided for moving the arms to their cutting position with their lower ends positioned radially outward from the body.

14 Claims, 3 Drawing Sheets

DRILLING APPARATUS AND CUTTER

This is a continuation of co-pending application Ser. No. 896,060 filed on August 13, 1986 now abandoned.

BACKGROUND OF THE INVENTION

I. Field of the Invention

This invention relates to underreamers and expansible cutters and, in particular, to an underreamer drill bit with a conical cutter having an improved cutter mounting.

II. Description of the Prior Art

Underreamers, expansible cutters and hole openers have been used for enlarging well bores either connected to a drill string above the drill bit or in the string without any drill bit on the lower end of the string. U.S. Pat. No. 3,386,521 is an example of the combined drill bit and underreamer and U.S. Pat. No. 3,171,503 is an example of an underreamer on the lower end of the drill string. U.S. Pat. No. 4,533,003 illustrates an improved means for securing a cutter to an underreamer arm.

Conical cutters have been used in drill bits and underreamers. Such conical cutters have been installed on a pin which extends downwardly and inwardly from the lower end of the underreamer arms. Roller bearings and balls have been used in mounting the conical cutters on the arms as shown in U.S. Pat. No. 2,641,447. Pins or balls locked in a groove between the arm and the interior of the conical cutter have been used to secure the cutters on their pins as shown in U.S. Pat. Nos. 2,661,447; 3,998,500; and 2,519,716. U.S. Pat. No. 4,161,343 discloses the use of a friction bearing and a thrust button between the pins and the cutters. Pat. No. 3,998,500 suggests the use of a bolt to secure a bearing sleeve on the pin. U.S. Pat. No. 4,478,299 shows a variety of bearings on the pin including a split bushing arrangement.

The amount of cutting that can be obtained from a conical cutter on an underreamer has been limited by the time in cutting service during which the cutter rotates relatively freely and this is a function of the efficiency of the mounting.

In the conventional conical cutter, i.e. cone bit, the cone is designed to roll around a circle as the cone bit turns. The radius of this circle is referred to as the natural rolling radius of the cone. As long as this rolling radius remains constant, wear on the cutter and its mounting assembly is relatively even and the cone bit will experience a good drilling life. However, when a cone bit is used in an underreamer, as the underreamer arms expand outwards in operation, the rolling radius is increased beyond the cone's normal rolling radius. The normal thrust load in a cone bit is directed head on against the cutter element. However, as the arms of the underreamer open, essentially all the loading on the cutter assembly is a reverse thrust load applied against the side of the cutter element. This reverse thrust load is the major element of the loading on the cutter assembly in an underreamer, particularly at the beginning of operation or if the underreamer only cuts a small shelf, because the underreamer only uses the outer rear edge of the cutter cone. Further, in a highly deviated hole, the reverse thrust lead is predominate. As the cutter assembly opens during operation, the reverse thrust load reduces, but remains a significant element of the loading on the cutter assembly. Additionally, during operation the cone bit always tries to return to its natural rolling radius; i.e. to close the underreamer or track-in which creates its own load against the cutter assembly. These varying loads placed upon the cutter assembly during operation cause excessive wearing and uneven wearing of the cutter mounting assembly. One effect of such uneven wearing and excessive wearing is rapid deterioration of the pin on the underreamer arm and the bearings which form a part of the cutter assembly. In practice, when wear of the pin on the underreamer arm occurs, the end portion of the underreamer arm is cut off and a new portion is welded on. The heat of such welding weakens the underreamer arm. Additionally, each time the arm is cut to weld on a new end portion, more of the original arm must be removed to replace the heat weakened section. Accordingly, the cutter assembly can be replaced only a few times.

SUMMARY OF THE PRESENT INVENTION

The present invention overcomes the disadvantages of the existing underreamer arm and cutter assemblies by providing an underreamer arm of a one-piece construction having no welded connections. Furthermore, there is essentially no wear on the underreamer arm or its pin element by the cutter assembly during operation so that it does not need to be frequently replaced. The cutter element is attached to the pin element on the underreamer arm by a construction which provides a high capacity load bearing surface not only for the normal thrust load, but also for the reverse thrust load, as well as a large surface area to carry the radial load applied on the cutter during drilling.

The present invention relates to an improved underreamer, hole opener, or expansible rotary drill but with a conical cutter having an improved cutter mounting. The underreamer includes a body with a bore therethrough, an arm pivotally mounted to the body at its upper end with a pin on its lower end, a detachable friction sleeve secured to the pin, a conical cutter having a central base, means for securing the pin and sleeve within the central bore of the cutter, and bearing means positioned between the exterior and end of the pin and sleeve assembly and the wall of the central bore of the cutter. The beqaring means is designed to take both the normal thrust and radial loads applied to the cutter during drilling and also the reverse thrust load which is placed on the cutter in an underreamer. The bearing means is connected so that the bearing means and the detachable sleeve prevent wear on the pin element of the underreamer since the sleeve remains stationary on the pin element and all movement occurs between the cutter element and the sleeve and bearings.

These and other objectives of the present invention are obtained in the embodiments of the present invention by utilizing a substantially cylindrical or cup-shaped sleeve which includes means for preventing rotation with respect to the pin of the underreamer arm. In addition, bearing means are provided between the sleeve and the cutter cone to reduce friction and increase the useful life of both the sleeve and the cutter. The bearing means are situated in order to carry the various thrust loads imparted upon the cutter during operation. Moreover, because of the minimal cost associated with manufacturing and replacing the sleeves, the costs associated with such drilling operations are reduced while extending the useful life of the underreamer arm and pin.

Other objects, features and advantages of the present invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the view and in which.

DETAILED DESCRIPTION OF A PREFERRED EMBODIMENT OF THE PRESENT INVENTION

Figure 1:
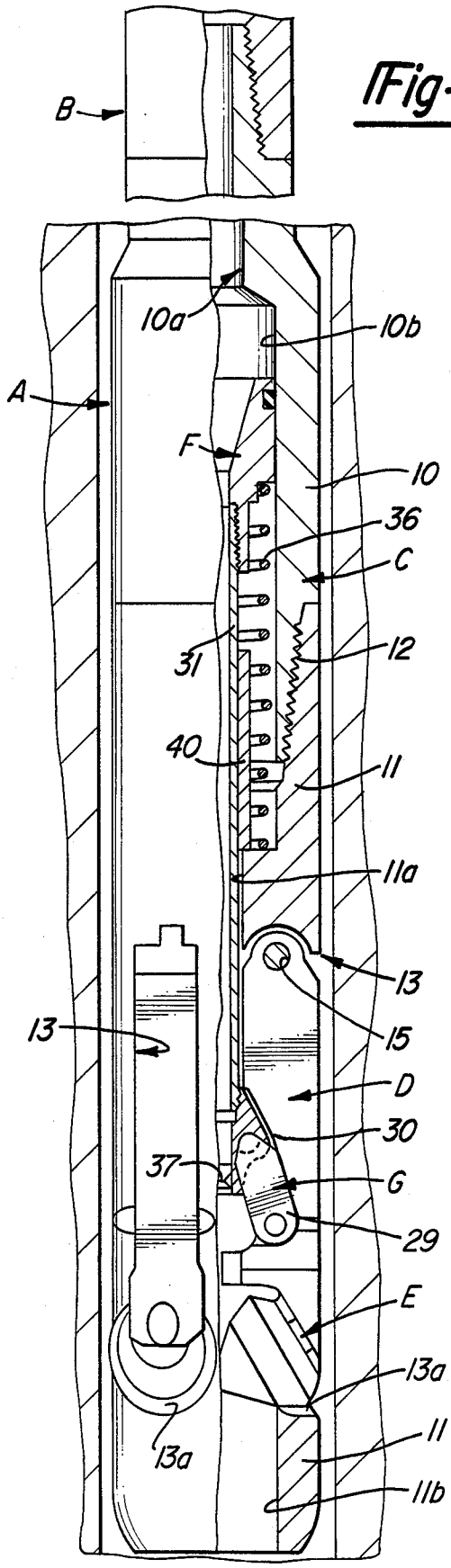
FIG. 1 is a view partly in section and partly in elevation showing the improved underreamer of the present invention in retracted or funning position.
Figure 2:
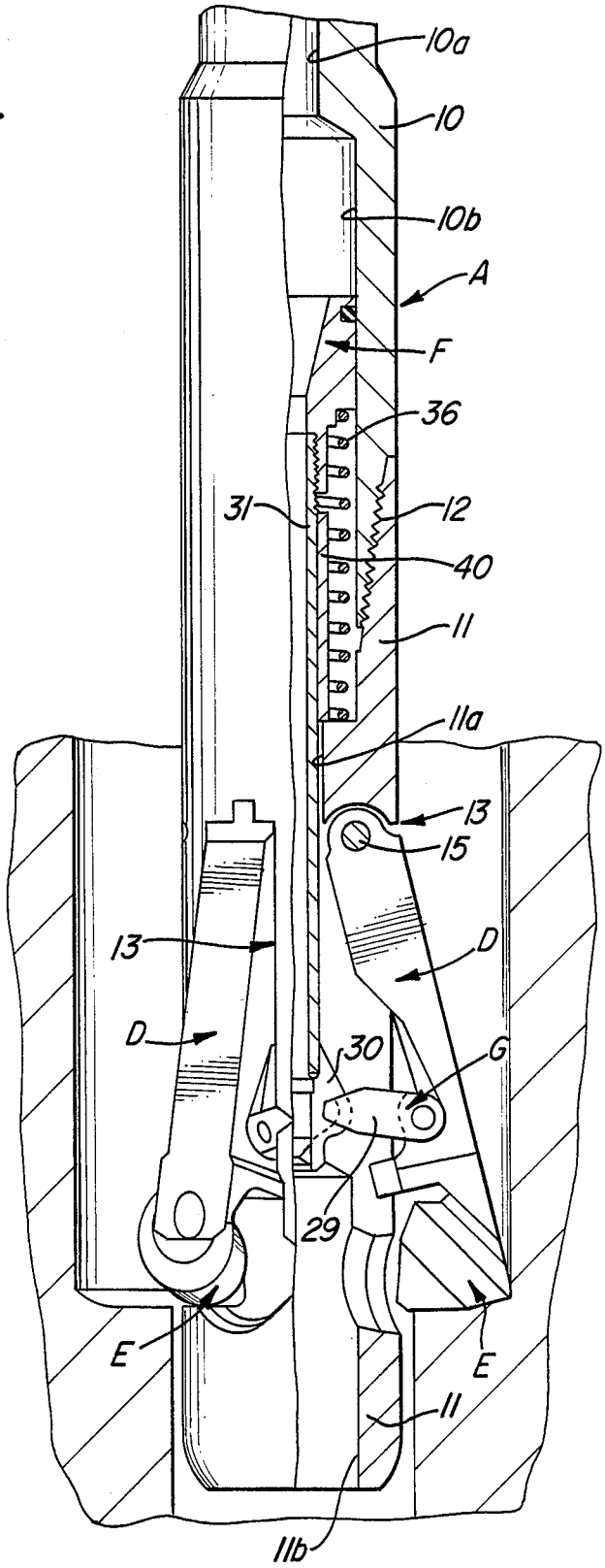
FIG. 2 is a similar view showing the underreamer in extended or cutting position.

Referring first to FIGS. 1 and 2, the expansible rotary drill bit or underreamer tool comprising the present invention is generally designated as A. The upper end of the tool is adapted to be secured to the lower end of a drill string B extending to the top of a well bore by means of which the tool A is ordinarily lowered through a string of well casing (not shown) to an area below the casing where the hole enlarging operation is to be carried out. In general, the tool A comprises main body portion C within which are provided cutter carrying elements or connecting arms D having cutter assemblies E at their lower ends. Actuating piston F is movable within the bore of main body portion C and is connected by way of movable links G to the cutter carrying elements or arms D. When piston F is moved downwardly, the lower ends of links G are swung outwardly which causes the arms D to swing outwardly thereby moving the cutter assemblies E outwardly in their expanded cutting position as shown in FIG. 2. In this position, rotation of the drill string rotates main body portion C and the cutter carrying elements whereby cutter assemblies E will enlarge or drill out the drill bore. When the piston returns to its upper position as shown in FIG. 1, the links G operate to retract the cutters.

Main body portion C comprises upper tubular section 10, having its upper end connected to drill pipe B, and lower housing 11 which is connected to the upper section 10 by threads 12. Upper section 10 has bore 10*a* which communicates with the bore, the drill pipe B and counterbore 10*b* within which piston F is slidably received. Housing 11 has an axial bore 11*a* extending entirely therethrough and lower end 11*b*.

A plurality of vertically extending slots 13 are formed within the body C which receive the cutter carrying elements or arms D. As shown, three such slots 13 are provided although the number may vary. Each slot 13 extends longitudinally of housing 11 and includes openings for the reception of the ends of pivot pin 15. Alternatively, the cutter arm D may be connected to the body C through an additional element such as a hinge pin block. The lower end of each slot terminates in circular opening 13*a* through which cutter assembly E, mounted on the lower end of each cutter carrying arm D, may move.

The construction of each cutter carrying element or arm D is substantially rectangular in cross-section, being provided with ears at its upper end having a transverse opening therein. The width of each arm is substantially the same as the width of slot 13 and when arm D is stored within the slot 13, pivot pin 15 extends through the opening such that each arm is pivotally mounted within each slot. The pivot pin 15 allows the arms D to be swung outwardly beyond the confines of the outer surface of housing 11 so that cutter assemblies E will be expanded as shown in FIG. 2.

In order to simultaneously expand the cutter arms D, each arm is connected through a pair of links 29 to a connecting element 30 which is directly connected through tubular sleeve 31 with the lower end of annular piston F. The connecting element 30 has a plurality of outwardly projecting lugs, each having an opening or recess therein. The upper ends of links 29 are disposed on each side of lugs 32 and each has an inwardly projecting lug which engages the opening or recess of the lug on element 30 to pivotally connect the upper ends of the links 29 to the lug.

When the annular piston F is in its raised position to which it is urged by a coil spring 36, the connecting element is also raised to be in close proximity to the inclined surface on the interior of each cutter arm D. By reason of the connection with the links 29, the links are swung to the position shown in FIG. 1 which causes their lower ends to move inwardly and maintain each arm retracted within the housing. An orifice ring 37 is mounted within the lower portion of the bore of the connecting element 30 (FIG. 1) and when pressure fluid is pumped downwardly through the drill stem and through the annular piston F as well as the connecting sleeve 31, the orifice ring creates a restriction which will cause a pressure build-up above piston F. When this increased pressure overcomes the force of the coil spring 36, the piston F, sleeve 31 and connecting element 30 move downwardly with respect to the housing and to the cutter arms. This moves the upper pivot point between the connecting links and element 30 downwardly which results in an outward swinging movement of the lower ends of the links 29. Such outward swinging movement causes the cutter arms D to pivot about the upper pin 15 whereby the lower ends of the arms are swung outwardly to move the cutters E to an expanded position. In order to control the radial expansion of the cutter arms, the downward movement of the annular piston F is limited by a stop sleeve 40 which surrounds the connecting sleeve 31 and rests upon an annular shoulder 11*d* formed between the bore 11*a* and the counter bore 11*c* of the housing 11. When the lower end of the piston engages the upper end of the stop sleeve 40, further downward movement of the piston is prevented to thereby limit the extent to which the lower end of links 29 are swung.

Figure 3:
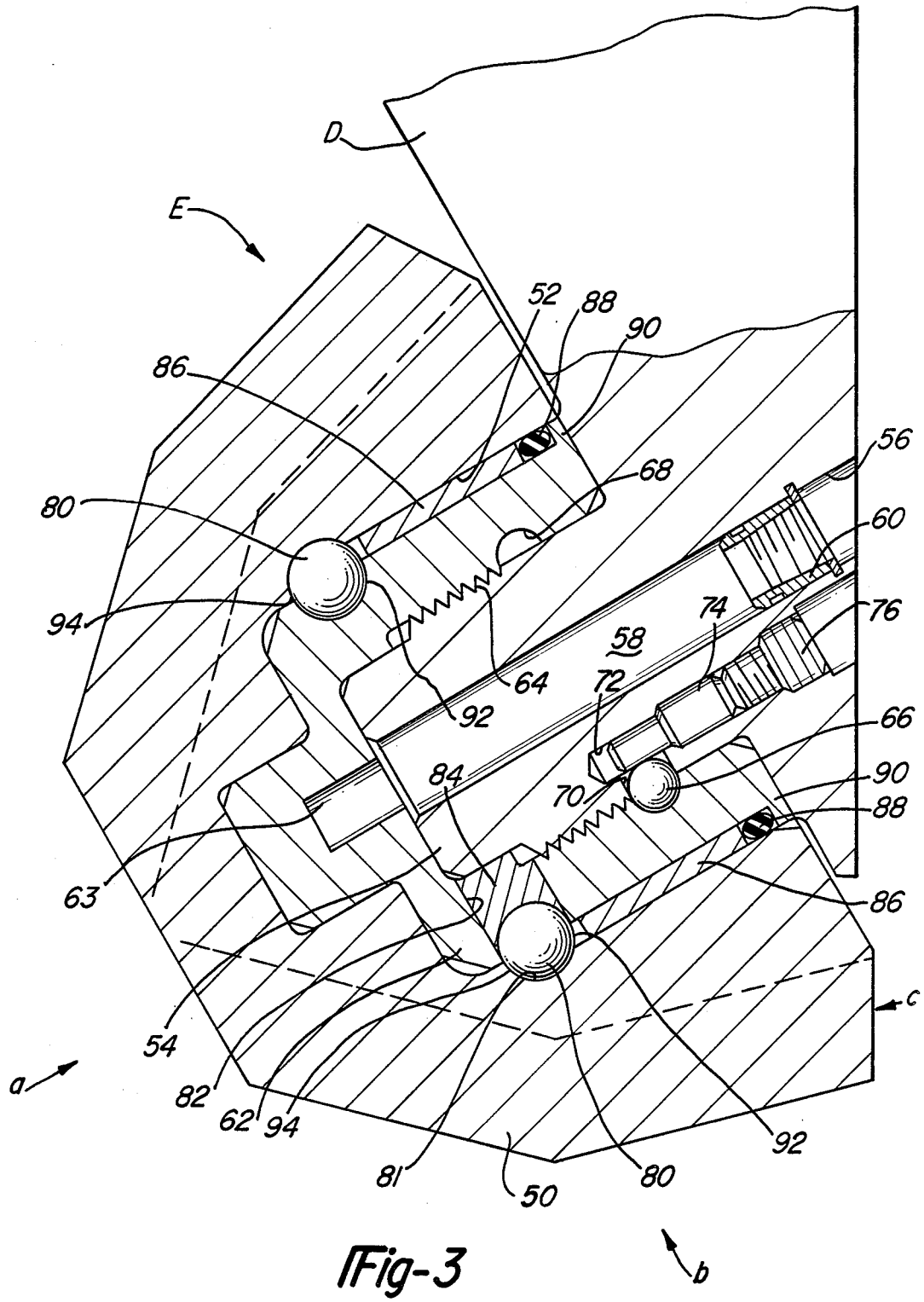
FIG. 3 is a detailed sectional view of the cutter assembly embodying the present invention.

Referring now to FIG. 3, the cutter assembly E includes a conical cutter 50 having suitable formation engaging elements (not shown), such as teeth or inserts. Cutter 50 is suitably shaped on its exterior as is well known in the art of conical cutters and has an internal bore 52 formed partially through the center thereof. The cutter assembly E includes means for securing the cutter 50 to pin 54 of arm D. The pin 54 is formed at the lower end of arm D substantially perpendicular thereto.

Pin 54 extends downwardly and inwardly from the lower end of arm D and has a central bore 56 extending therethrough. Central bore 56 forms a portion of the grease chamber 58 for providing a supply of grease to the interacting components of the cutter assembly E. A plug 60 disposed proximate the outer end of the bore 56 operates as a piston to supply lubricant to the assembly and is exposed to the well pressure which acts against the plug 60 to keep pressure on the grease during operation of the cutter assembly.

Secured to the pin 54 is a sleeve or bearing member 62 which engages the internal bore 52 of the cutter 50 in order to receive the wear caused by the rotation of the cutter cone 50. In the embodiment shown in FIG. 3, the sleeve member 62 is a substantially one-piece, cup-shaped member which surrounds the pin 54 and is attached thereto by cooperating threads 64 formed along the outer cylindrical wall of the pin 54. In the alternative, the sleeve member 62 may be open-ended such that the end of the pin 54 is exposed but not in contact with the internal bore 52 of the cutter 50. In either embodiment it is readily seen that wear upon the pin 54 is eliminated while the conical cutter 50 is free to rotate. A milled transverse slot 63 is formed in the sleeve member 62 proximate the end of the internal bore 56 of the pin 54 in order to facilitate removal of the sleeve member 62 for replacement as will be subsequently described.

A lock bearing 66 is utilized to prevent inadvertent detachment of the sleeve member 62 from the pin 54. Upon assembly, the bearing 66 extends into groove 68 formed in the sleeve member 62. The lock bearing 66 is positionally captured within a side bore 70 extending from longitudinal bore 72 by key element 74. Once the sleeve member 62 is attached to the pin 54, the key element 74 is placed into the bore 72 to force the bearing 66 into groove 68 thereby locking the two components together. A secondary key element 76 may also be provided to prevent removal of key element 74. Preferably, key element 76 is threadably secured within the bore 72 while key element 74 is free to rotate therein. Alternatively, only one key element having a threaded portion is utilized to retain the lock bearing 66.

Assembly means are also provided for securing the conical cutter 50 to the sleeve member 62 which provides free rotational movement of the cutter 50 while also taking the various loads associated with the underreaming process. The assembly means includes a plurality of ball bearings 80 circumferentially spaced within a groove 81C formed between the sleeve member 62 and the cutter cone 50. The bearings 80 are inserted by way of bore 82 and manually forced into place and held by the plug 84. In addition, a journal bearing 86 is disposed between the cutter cone 50 and the sleeve member 62 to reduce frictional wear between the components. Alternatively, a plurality of roller bearings may be utilized in place of the journal bearing. Finally, an O-ring seal 88 is included to prevent loss of grease which passes between the bearings to provide proper lubrication. In the preferred embodiment, the sleeve member 62 includes a peripheral flange 90 which provides proper spacing for the O-ring seal 88 as well as the journal bearing 86.

To assemble the cutter assembly E shown in FIG. 3, the cutter cone 50 is first secured to the sleeve member 62 with the bearing 86 and seal 88 disposed therebetween. After inserting the sleeve member 62 into the internal bore 52 of cutter 50, the ball bearings 80 are placed into the groove 81 and held into place by the plug 84. The cutter 50 and sleeve member 62 are then threadably mounted to the pin 54. If necessary, the slot 63 can be accessed through bore 56 to facilitate rotation of the sleeve member 62 since the cutter cone 50 will tend to rotate independently of the sleeve. Once assembled, the locking bearing 66 is positioned and locked into place by the key element 74.

Placement of plug 60 creates with the bore 56 a grease chamber for lubrication of the cutter assembly E. This chamber provides lubrication to the bearings 80 and 86 and to the various load bearing surfaces through a series of grease slots provided in the inner and outer walls of the sleeve member 62.

In use, the cutter assembly operates in a normal fashion to cut a hole. However, when the cutter is rotating, all movement is on the exterior surface of the sleeve member 62. The outer surface of the side wall of sleeve 62 takes the radial load "b" placed on the cutter assembly during cutting of the hole. The reverse thrust load "c", however, is taken by the surface 92 of the ball bearings 80. The normal thrust load "a" is taken by the bottom surface of the sleeve member 62 and the bottom surface 94 of the ball bearings 80. By providing a means to absorb these various thrust loads, the present invention provides a cutter assembly that is capable of a longer life than past known assemblies. Additionally, since no rotation occurs around pin 54, no wear occurs on pin 52 and the underreamer arm need not be cut to have a new pin attached. However, when the sleeve member 62 has become sufficiently worn to require replacement, the sleeve 62 can be removed and replaced at a minimum of cost.

Figure 4:
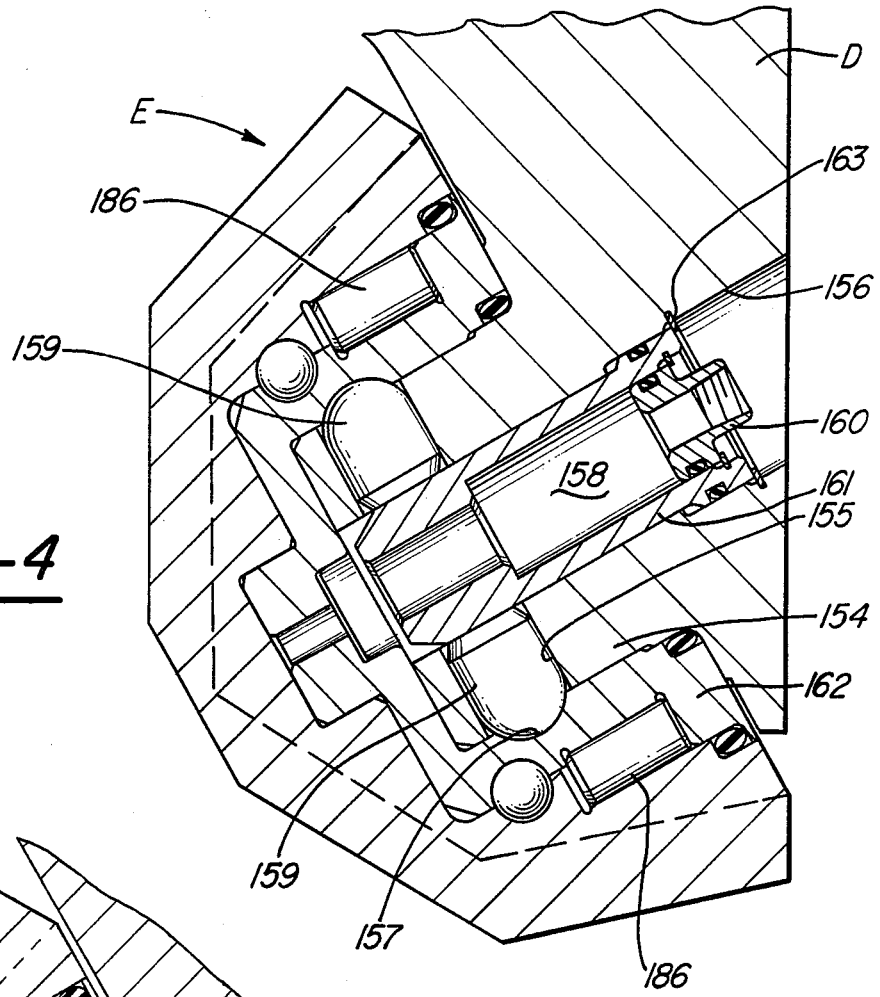
FIG. 4 is a detailed sectional view of a second embodiment of the cutter assembly of the present invention.

The embodiment of FIG. 4 shows an alternate means of mounting the sleeve or bearing member to the pin which prevents rotation between the sleeve and the pin. As shown in FIG. 4, the pin 154 has a plurality of side bores 155 drilled at right angles to the central bore 156. In addition, partial bores 157 are drilled in the sleeve member 162, one bore 157 for each side bore 156. Pin elements 159 are provided to hold the sleeve member 162 stationary with respect to the pin 154 during operation of the cutter. Each pin element 159 includes a main body having a forward machined surface which fits into and closely conforms to the partial bore 157. Upon assembly of the sleeve member 162, a retaining member 161 retains the pin elements 159 within the bores 157 to lock the sleeve member 162 in place. Retaining member 161 slides within the bore 156 and has a lower end which positions the pin elements 159 outwardly. A snap ring 163 retains the retaining member 161 within the central bore 156 after assembly. The plug 160 is utilized to form a grease chamber 158 which provides lubrication of the cooperating elements of the cutter assembly E. In the embodiment shown in FIG. 4, the journal bearing has been replaced by roller bearing 186 although it is to be understood that either type of bearing assembly can be utilized.

Figure 5:
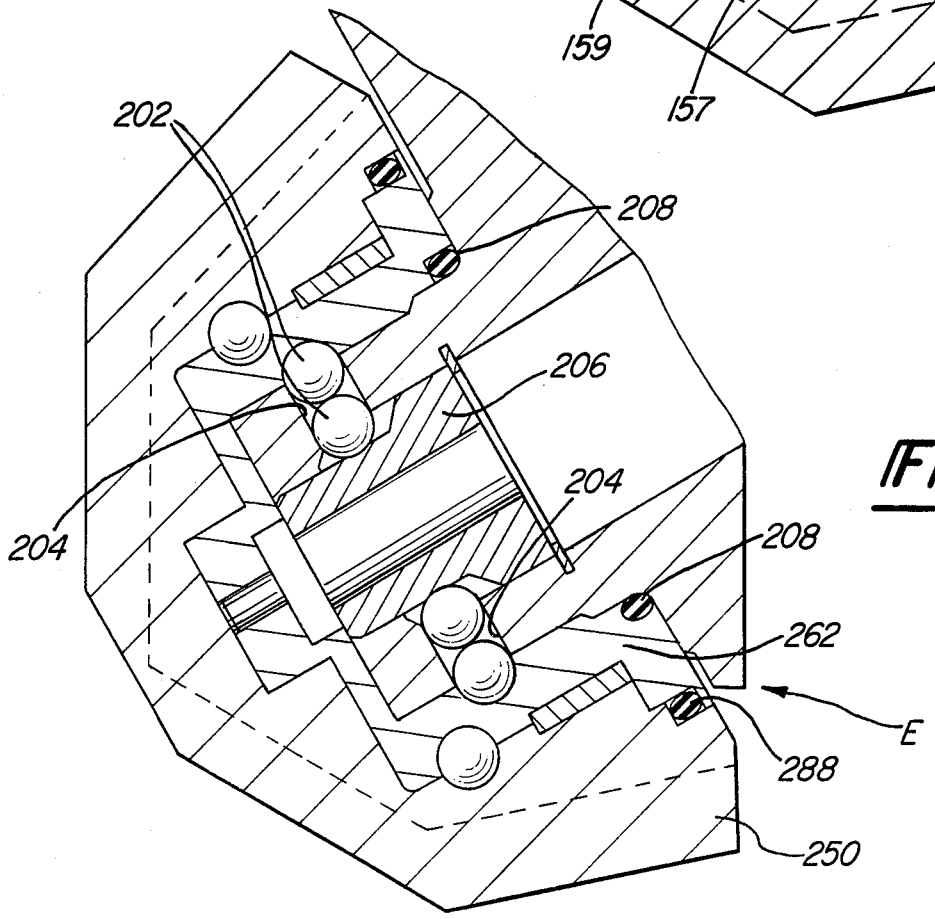
FIG. 5 is a detailed sectional view of a still further embodiment of the cutter asembly of the present invention.

A still further embodiment of the present invention is shown in FIG. 5. In this embodiment, ball bearings 202 are used in place of pins 159 to retain the sleeve member. Ball bearings 202 are inserted into bores 204 and manually forced into place and held by the retaining member 206. A secondary O-ring seal 208 is provided to prevent escape of lubricants as well as to prevent contaminants from entering the cutter assembly. However, unlike the outer seal 288, the seal 208 does not rotate with the cutter and thereby does not cause wear on the pin 264. As with the other embodiments, the embodiment of FIG. 5 is easily assembled by placing the sleeve member 262 and cutter 250 over the pin and thereafter forcing the ball bearings 202 into engagement with the sleeve member 262.

Thus, the present invention provides an underreamer construction which is capable of handling high thrust loads with essentially no wear on the underreamer arm or its pin element by the cutter assembly so that it does not need to be frequently replaced. Repair of the disclosed construction is simple and inexpensive since only the sleeve member will need to be replaced due to wear from the various thrust loads.

The foregoing detailed description has been given for clearness of understanding only and no unnecessary limitations should be understood therefrom as some modifications will be obvious to those skilled in the art without departing from the scope and spirit of the appended claims.

We claim:

1. A drilling apparatus comprising:

a body having a bore therethrough and at least one longitudinal slot in its wall;

an arm pivotally mounted at its upper end to one of said slots of said body, said arm including pin means integrally formed at the lower end thereof to form a one-piece arm and pin assembly;

a cutter having formation cutting means around its outer periphery, a central bore extending partially therethrough having an annular side wall;

a substantially cup-shaped, one-piece sleeve member threadably mounted to said pin means and engaging said central bore of said cutter;

mounting means extending through said pin means of said arm for detachably securing said sleeve member to said pin means and including means for preventing rotation between said sleeve member and said pin means wherein rotational contact between said cutter and said arm is prevented thereby eliminating frictional wear of said pin means to maintain the integrity of said pin means and arm; and assembly means for securing said cutter rotationally on said sleeve member and assembly means including ball bearing means disposed between said cutter and said sleeve member to counter thrust loads during drilling.

2. The apparatus as defined in claim 1 wherein said sleeve member is of one-piece construction being substantially cup-shaped to surround said pin means and prevent rotational contact between said cutter and said pin means.

3. The apparatus as defined in claim 1 wherein said means for preventing rotation of said sleeve member includes at least one locking bearing positionally captured between said pin means and said sleeve member by at least one key element rotatively received within a bore extending parallel to the central axis of said pin means and disposed radially outwardly from the center of said pin means.

4. The apparatus as defined in claim 2 wherein said mounting means includes at least one pin element, said pin means having a central bore, side bore means in the side of said pin means extending from the outside of said pin means into said central bore of said pin means, said pin element being adapted to slide within said side bore means such that in a first position at least a portion thereof extends into said central bore of said pin means and in a second position at least a portion thereof extends into a notch formed in said sleeve member to act as said means for preventing rotation of said sleeve member, and means in said central bore of the pin means for retaining said pin element in said second position.

5. The apparatus as defined in claim 4 wherein said at least one pin element comprises a plurality of ball bearings to prevent rotation of said sleeve member.

6. The apparatus as defined in claim 1 and further comprising plug means slidable within a central bore of said pin means wherein said plug means is exposed to well pressure during operation of the drilling apparatus and means for retaining said plug means in said central bore, said plug means defining within said central bore of said pin means a grease chamber adapted to be filled with grease under pressure with said plug means being responsive to well pressure to keep pressure on said grease chamber.

7. A drilling apparatus comprising:

a body having a bore therethrough and at least one longitudinal slot in its wall;

an arm pivotally mounted at its upper end to one of said slots of said body, said arm including pin means formed at the lower end thereof;

a cutter having formation cutting means around its outer periphery, a central bore extending partially therethrough having an annular side wall;

a substantially cup-shaped sleeve member mounted to said pin means of said arm and engaging said central bore of said cutter;

mounting means extending through said arm for detachably securing said sleeve member to said pin means and including means for preventing rotation between said sleeve member and said pin means, said means for preventing rotation includes at least one locking bearing positionally captured between said pin means and said sleeve member by at least one key element rotatively received within a bore extending parallel to the central axis of said pin means and disposed radially outwardly from the center of said pin means; and assembly means for securing said cutter rotationally on said sleeve member.

8. The apparatus as defined in claim 7 wherein said sleeve member is of one-piece construction being substantially cup-shaped to surround said pin means thereby preventing rotational contact between said cutter and said pin means.

9. The apparatus as defined in claim 8 wherein said sleeve member is threadably mounted to said pin means.

10. The apparatus as defined in claim 8 wherein said arm and said pin means are integrally formed on one-piece construction, said sleeve member preventing frictional wear of said pin means by said rotating cutter whereby said pin means remains integral with said arm.

11. A cutter arm adapted to be used in a drilling apparatus having a main body, said arm being pivotally mounted at its upper end to a slot formed in the body of the drilling apparatus, said arm comprising:

pin means integrally formed with said arm to form a one-piece arm and pin assembly, said pin means having a substantially cylindrical configuration;

a bearing member mounted to said pin means and including means for preventing rotation of said bearing member on said pin means, said bearing member being substantially cylindrically cup-shaped to surround said pin means;

a cutter having formation cutting means around its outer periphery and rotationally mounted to said bearing member; and bearing means disposed between said cutter and said bearing member, said bearing means adapted to absorb the thrust loads applied to said cutter of said apparatus;

said bearing member fixedly mounted to said pin means between said pin means and said cutter to prevent rotational contact between said cutter and said pin means wherein frictional wear on said arm and pin assembly is prevented such that the loads associated with the drilling operation are absorbed by said bearing member and said bearing means while said pin means remains integrally formed with said arm;

said means for preventing rotation of said bearing member on said pin means includes at least one locking bearing positionally captured between said pin means and said bearing member by at least one key element received within a bore extending parallel to the central axis of said pin means.

12. A drilling apparatus comprising:

a body having a bore therethrough and at least one longitudinal slot in its wall;

an arm pivotally mounted at its upper end to one of said slots of said body, said arm including pin means formed at the lower end thereof;

a cutter having formation cutting means around its outer periphery, a central bore extending partially therethrough having an annular side wall;

a substantially cup-shaped sleeve member mounted to said pin means of said arm and engaging said central bore of said cutter, said sleeve member adapted to surround said pin means and prevent rotational contact between said cutter and said pin means;

mounting means including at least one pin element extending through said pin means of said arm for detachably securing said sleeve member to said pin means, said pin means having a central bore, side bore means in the side of said pin means extending from the outside of said pin means into said central bore of said pin means, said pin element being adapted to slide within said side bore means such that in a first position at least a portion thereof extends into said central bore of said pin means and in a second position at least a portion thereof extends into a notch formed in said sleeve member to prevent rotation of said sleeve member, and means in said central bore of the pin means for retaining said pin element in said second position; and assembly means for securing said cutter rotationally on said sleeve member and counter thrust loads during drilling.

13. The apparatus as defined in claim 12 wherein said at least one pin element comprises a pin having a head, said bore means including a notch in which said head slides, at least a portion of said pin extending into said central bore of said pin means.

14. The apparatus as defined in claim 12 wherein said at least one pin element comprises a plurality of ball bearings to prevent rotation of said sleeve member.

* * * * *